United States Patent [19]

Yasuda

[11] Patent Number: 4,496,091

[45] Date of Patent: Jan. 29, 1985

[54] STAPLER

[76] Inventor: Yasuo Yasuda, 2265-24, Togasaki, Misato-shi, Saitama-ken, Japan

[21] Appl. No.: 425,394

[22] Filed: Sep. 28, 1982

[51] Int. Cl.[3] ..... B25C 5/02; B25C 5/11

[52] U.S. Cl. ..... 227/123; 227/120

[58] Field of Search ..... 227/120, 123, 125, 126, 227/127, 128

[56] References Cited

U.S. PATENT DOCUMENTS

| | | | |
|---|---|---|---|
| 2,551,898 | 5/1951 | Nyberg | 227/125 |
| 3,076,195 | 2/1963 | Jopp | 227/123 |
| 3,516,590 | 6/1970 | Timmerbeil et al. | 227/123 |
| 4,187,971 | 2/1980 | Prew, Jr. | 227/125 |
| 4,243,168 | 1/1981 | Balma | 227/119 |

*Primary Examiner*—Paul A. Bell

*Attorney, Agent, or Firm*—McAulay, Fields, Fisher, Goldstein & Nissen

[57] ABSTRACT

A stapler for binding sheets of papers by driving a stapler into stacked sheets of paper. The stapler has a base member provided with an anvil plate, a staple magazine member and a driving member provided with a staple drive plate. The base member, staple magazine member and the driving member are pivotally secured at their base ends to one another by means of a pivot pin. The stapler comprises a staple guide member mounted in the staple magazine member for sliding movement in forward and backward directions while leaving a staple drive clearance in the end of the staple magazine member. The stapler further comprises a staple feeder connected to the driving member and mounted in the staple guide member for sliding movement in the forward and backward directions, and a resilient member disposed around the pivot shaft, the resilient member being retained at its front bent end by the staple guide member and at its rear bent end by the staple magazine member.

6 Claims, 4 Drawing Figures

STAPLER

BACKGROUND OF THE INVENTION

1. Field of the Invention

The present invention relates to a stapler for use in binding or stitching sheets of paper, having a base member provided with an anvil plate, a staple magazine member and a driving member provided with a staple drive plate, all of which are pivotally secured to one another at their base ends by means of a pivot pin.

2. Description of the Prior Art

In the conventional stapler, a staple feeder feeds a series of staples to bring the staples one by one into a staple drive clearance or space formed at the free end of the staple magazine member. The staple is driven through the clearance by a staple drive plate atached to the driving member to penetrate stacked sheets of paper. The staple is then deformed as it is pressed against an anvil plate on the base member thereby to stitch or bind the sheets of paper. At times the staple drive clearance is jammed by the staple rendering the stapler inoperative. This may be due to lack of precision in fabrication of the stapler, wear or other reasons. Once the staple drive space is jammed, it is troublesome to get rid of the staple which has been deformed and caught in the staple drive clearance.

Another problem experienced with this type of conventional stapler is that, since the staple feeder is always biased by a coiled spring or the like towards the staple drive clearance, it is necessary to manually retract the staple feeder by the fingers to overcome the force of a coiled spring.

SUMMARY OF THE INVENTION

OBJECT OF THE INVENTION

Accordingly, it is an object of the invention to provide a stapler which avoids the jamming of the staple drive clearance with the staple and to facilitate the removal of the jammed staple, while permitting easy loading of the staples by a novel feature employing a connecting member which connects the driving member and the staple feeder.

BRIEF SUMMARY OF THE INVENTION

To this end, according to one aspect of the invention, there is provided a stapler having a base member provided with an anvil plate, a staple magazine member and a driving member provided with a staple drive plate, the base member, staple magazine member and the driving member being pivotally secured at their base ends to one another by means of a pivot pin. The staple guide member is mounted in the staple magazine member for sliding movement in forward and backward directions while leaving a staple drive clearance at the end of said staple magazine member. A staple feeder is connected to the driving member and mounted in the staple guide member for sliding movement in the forward and backward directions; and a resilient member is disposed around the pivot shaft; the resilient member being retained at its front bent end by the staple guide member and at its rear bent end by the staple magazine member.

The above and other objects, features and advantages of the invention will become clear from the following description of the preferred embodiment taken in conjunction with the accompanying drawings.

DESCRIPTION OF THE PREFERRED EMBODIMENTS

Figure 1:
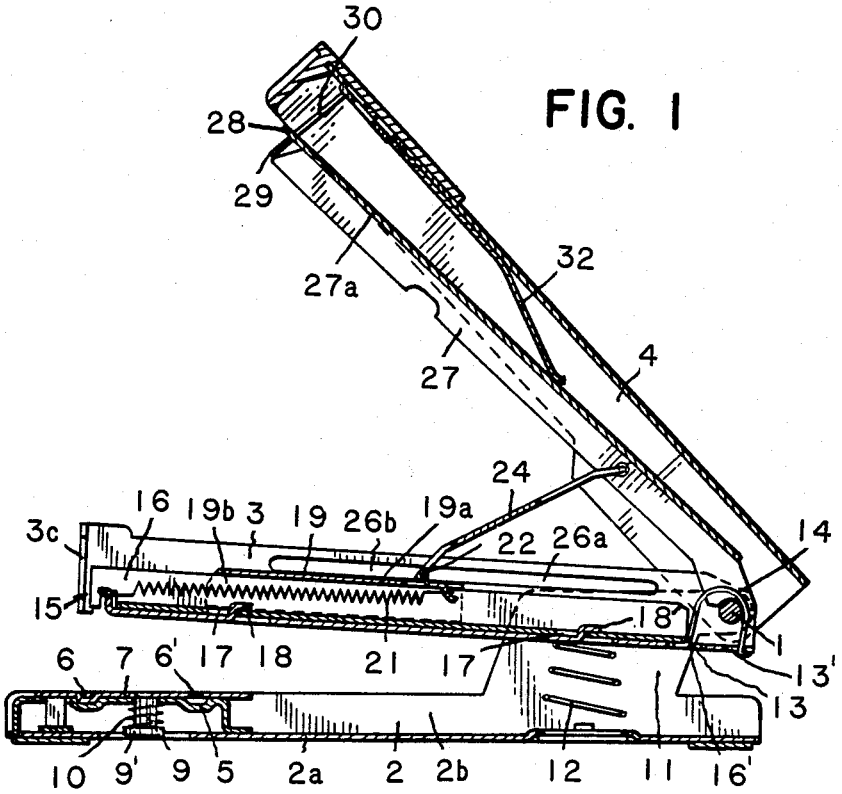
FIG. 1 is a sectional side elevational view of a stapler in accordance with an embodiment of the invention, with a driving member swung slightly upwardly.
Figure 2:
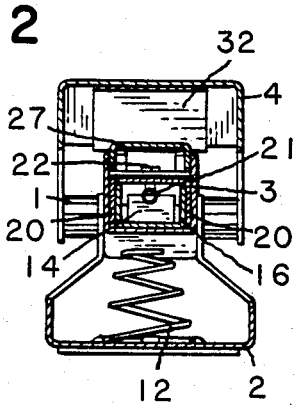
FIG. 2 is a sectional front elevational view of the stapler shown in FIG. 1.
Figure 3:
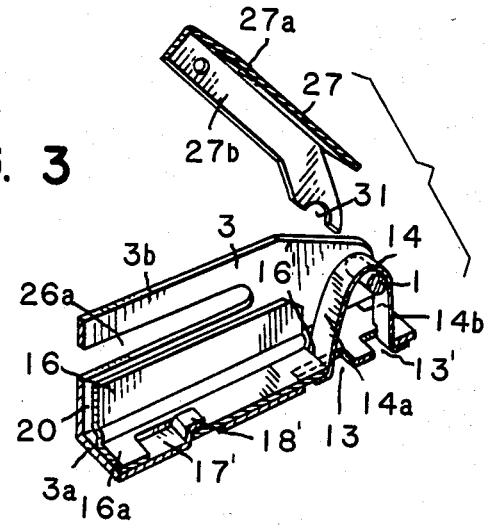
FIG. 3 is a partly cut-away perspective view of the stapler shown in FIG. 1 with the base member thereof omitted.
Figure 4:
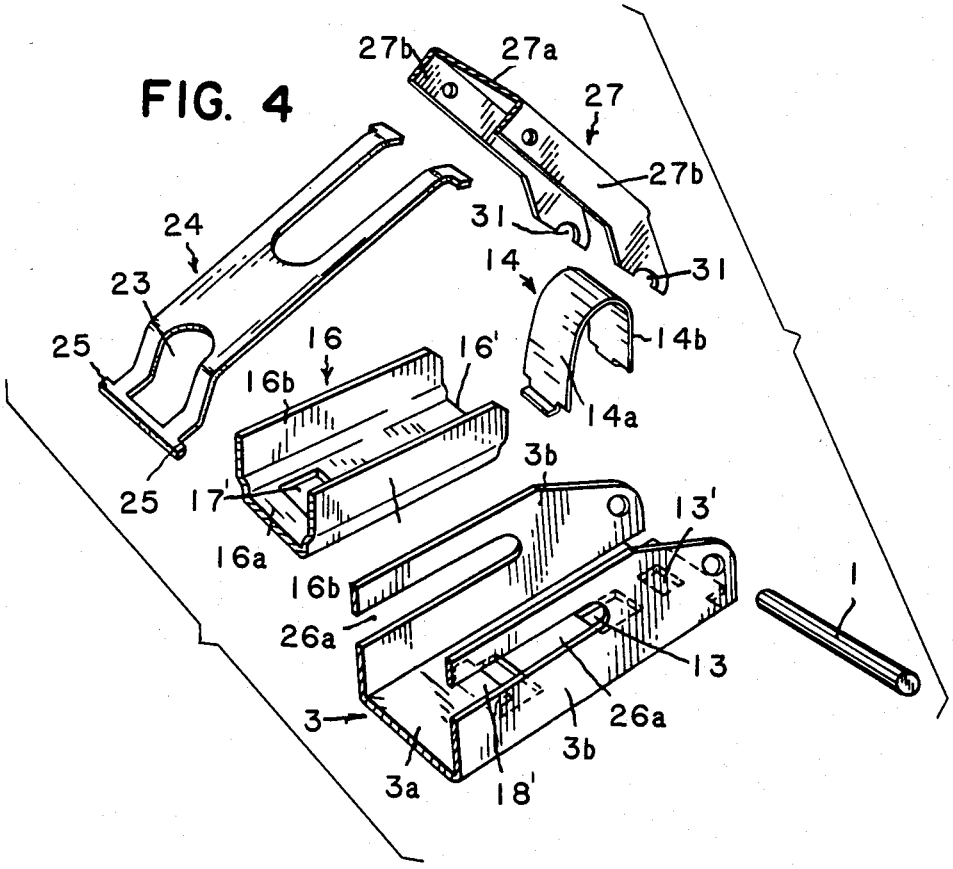
FIG. 4 is a partly cut-away perspective view of the stapler shown in FIG. 1 with the base member thereof omitted.

Referring to the drawings, a stapler in accordance with a preferred embodiment of the invention has three major members: namely, a base member 2, a staple magazine member 3 and a drive member 4 all of which are pivotally secured to one another at their base or rear ends by a pivot pin 1. The base member 2 is a channel-like member having a substantially inverted U-shaped cross-section composed of a bottom wall 2*a* and two side walls 2*b*,2*b* standing upright from both sides of the bottom wall 2*a*. An anvil support 5 is fixed between the side walls 2*b*,2*b* at the free end portion of the base member 2. An anvil plate 7 is rotatably secured to the anvil support 5 by means of a pivot pin 9 fixed to the center thereof and extending through the anvil support 5. Outward staple guide grooves 6 and inward staple guide groove 6' are formed in one and the other end portions of the upper surface of the anvil plate 7. A coiled spring 10 is compressed between the anvil support 5 and the head 9' of the pivot pin 9. The rear end portions of the side walls 2*b*,2*b* are extended to provide supporting walls 11,11 which receive the aforementioned pivot pin 1 which in turn pivotally secures the staple magazine member 3 and the driving member 4 as stated before. A coiled spring 12 is loaded between the staple magazine member 3 and the bottom wall 2*a* of the base member 2.

The staple magazine member 3 is a channel-like member having a substantially U-shaped cross-section, composed of a bottom wall 3*a* and both side walls 3*b*,3*b*. A pair of apertures, a front aperture 13 and a rear aperture 13', are formed in the rear end portion of the bottom wall 3*a*. The front aperture 13 retains the front bent end 14*a* of a resilient member 14 which extends about round the pivot shaft 1 while the rear aperture 13' retains the rear bent end 14*b* of the resilient member 14. A staple drive clearance or space 15 is formed between the end of the bottom wall 3*a* and a front wall 3*c* of the staple magazine member 3. Adjacent the staple drive clearance 15 is a staple guide member 16 having a substantially U-shaped cross-section mounted between the side walls 3*b*,3*b*, i.e. in the staple magazine member 3, for sliding movement in the back and forth directions. The staple guide member 16 is engaged at its rear end 16' by the front bent end 14*a* of the resilient member 14. The staple guide member 16 has a bottom wall 16*a* in which formed are a pair of elongated holes 17,17' extending in the longitudinal direction of the staple guide member 16. These elongated holes receive stop 18,18' which are formed by cutting and raising corresponding portions of the bottom wall 3*a* of the staple magazine member 3. A staple feeder 19 mounted slidably on the staple guide member 16 is a channel-like member having a substantially inverted U-shaped cross-section and comprising a top wall 19*a* and side walls 19*b*,19*b*. Each side wall 19*b* is received in corresponding gap 20 which is formed between corresponding side walls 3*b* and 16*b* of the staple magazine member 3 and the staple guide member 16, so that the staple feeder 19 is slidable along the length of the staple guide member 16 in the back and forth directions. A coiled spring 21 is positioned between the top wall 19*a* of the staple feeder 19 and the bottom wall 3*a* of the staple magazine member 3. A retaining tab 22 extends from the central portion of rear end of the top wall 19*a*. A connecting plate 24 is provided at its other end with an aperture which is adapted to engage with the retaining tab 22. The connecting plate 24 has two projections 25,25 extending laterally from both side edges thereof near the end having the aperture 23. The lateral projections 25,25 are slidably received by elongated slots 26*a*,26*a* formed in the side walls 3*b*,3*b* of the staple magazine member 3. The lateral projections 25,25 are slidable also along elongated grooves 26*b*,26*b* which are formed on the extensions of the elongated slots 26*a*,26*a*. The connecting plate 24 is pivotally secured at its other end to side walls 27*b*,27*b* of a staple pressing member 27 mounted in the driving member 4. The staple pressing member 27 has a substantially inverted U-shaped cross-section comprising side walls 27*b*,27*b* mentioned above and a top wall 27*a*. A tab 28 projecting from the center of the free end of the top wall 27*a* is received by an elongated hole 30 formed in a staple drive plate 29 fixed to the driving member 4. The side walls 27*b*,27*b* are provided at their rear ends with notches 31,31 which receive and engage the aforementioned pivot shaft 1. The staple pressing member 27 is biased away from the top wall of the driving member 4 by a leaf spring 32 acting between the top wall of the driving member, which also has an inverted U-shaped cross-section, and the top wall 27*a* of the staple pressing member 27.

In use, as the driving member is pivotally moved upward around the fulcrum constituted by the pivot pin 1, the connecting plate 24 is pulled by the driving member 4 due to the engagement of retaining tab 22 of the staple feeder 19 in the aperture 23 formed in the connecting plate 24. In consequence, the staple feeder 19 is slid rearwardly overcoming the force of the coiled spring 21 to afford a space for the mounting of the staples on the staple guide member 16 in the staple magazine member 3. Thus, the space for loading the staples is automatically provided simply by swinging the driving member 4 upwardly as stated.

After the loading, the series of staples are pressed forwardly, i.e. toward the staple drive clearance 15, by the staple feeder 19 which tends to resume the initial position by the resetting force of the coiled spring 21. Then, as the driving member 4 is pressed down, the staples are severed and driven one by one to stitch or bind sheets of paper by the force exerted by the staple drive plate 29 fixed to the driving member 4.

In the event that the thus driven staple tends to jam the staple guide clearance 15 for any reason, the staple guide member 16 is forced back automatically by the reactional force exerted by this staple, overcoming the force of the resilient member 14, so that this staple can be ejected easily by the staple drive plate 29 out of the staple drive clearance 15.

Although the invention has been described through specific terms, it is to be noted here that the described embodiment is not exclusive and various changes and modifications may be imparted thereto without departing from the scope or spirit of the invention which is limited solely by the appended claims.

What is claimed is:

1. A stapler having a base member provided with an anvil plate, a staple magazine member and a driving member provided with a staple drive plate, said base member, staple magazine member and said driving member being pivotally secured at their base ends to one another by means of a pivot pin, characterized in that: a staple guide member is mounted in said staple magazine member for sliding movement in forward and backward directions and is spaced from the end of said magazine member to leave a staple drive clearance therebetween; a staple feeder connected to said driving member and mounted in said staple guide member for sliding movement in the forward and backward directions; and a resilient member having front and rear ends disposed around said pivot pin; said resilient member engaging said staple guide member at its front end and said staple magazine member at its rear end to bias said staple guide member forwardly.

2. A stapler according to claim 1, in which said staple guide member has a substantially U-shaped cross-section, said staple feeder having a substantially inverted U-shaped cross-section, and a spring connected between said staple feeder and the end of said staple guide member; a connecting plate pivotally secured at one end to a rear portion of said driving member and slidably secured at its other end to said staple magazine member; a retaining tab formed on the upper surface of said staple feeder at the rear end portion thereof and engageable with said other end of said connecting plate.

3. A stapler according to claim 1, in which said resilient member comprises a U-shaped spring member having front and rear bent ends, said front bent end engaging said staple guide member and said rear bent end engaging said staple magazine member, whereby said resilient member biases said staple guide member to a forward position.

4. A stapler according to claim 1, and a spring connected between said staple feeder and the end of said staple guide member; and a connecting plate pivotally secured at its one end to a rear portion of said driving member and slidably secured at its other end to said staple magazine member; a retaining tab formed on the upper surface of said staple feeder at the rear end portion thereof and engageable with said other end of said connecting plate.

5. A stapler according to claim 3, and a spring connected between said staple feeder and the end of said staple guide member.

6. A stapler according to claim 1, and a retaining tab extending from the upper surface of a rear end portion of said staple feeder, a connecting plate engageable at its one end with said retaining tab, said connecting plate being slidably secured at said one end to said staple magazine member and pivotally secured at its other end to a rear end portion of said driving member.

* * * * *